US010988222B1

(12) United States Patent
Langenfeld et al.

(10) Patent No.: US 10,988,222 B1
(45) Date of Patent: Apr. 27, 2021

(54) OUTBOARD MOTORS AND TIE BAR APPARATUSES FOR COUPLING AN OUTBOARD MOTOR TO AN ADJACENT OUTBOARD MOTOR

(71) Applicant: Brunswick Corporation, Mettawa, IL (US)

(72) Inventors: Gregg D. Langenfeld, Fond du Lac, WI (US); Thomas G. Theisen, Fond du Lac, WI (US); Laxmi N. Balla, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/664,231

(22) Filed: Oct. 25, 2019

(51) Int. Cl.

| | |
|---|---|
| ***B63H 20/06*** | (2006.01) |
| ***B63H 20/28*** | (2006.01) |
| ***F01P 11/02*** | (2006.01) |
| ***F01P 3/20*** | (2006.01) |
| *F01P 3/00* | (2006.01) |

(52) U.S. Cl.
CPC ..... *B63H 20/06* (2013.01); *B63H 20/28* (2013.01); *F01P 3/202* (2013.01); *F01P 11/0285* (2013.01); *F01P 2003/001* (2013.01)

(58) Field of Classification Search
CPC ..... B63H 20/00; B63H 20/02; B63H 20/06; B63H 20/08; B63H 20/12; B63H 5/125; B63H 5/25; B63H 5/20; B63H 20/28; F01P 3/202; F01P 11/0285; F01P 2003/001
USPC ..... 440/53, 63, 61 S
See application file for complete search history.

(56) References Cited

U.S. PATENT DOCUMENTS

| | | | | |
|---|---|---|---|---|
| 2,590,820 | A * | 3/1952 | Jedlicka | B63H 21/265 440/63 |
| 6,913,497 | B1 | 7/2005 | Ahlswede et al. | |
| 7,207,854 | B1 | 4/2007 | Anderson, Jr. et al. | |
| 8,500,501 | B1 | 8/2013 | Taylor et al. | |
| 8,512,085 | B1 | 8/2013 | Kobilic | |
| 9,365,274 | B1 | 6/2016 | George et al. | |
| 9,376,191 | B1 | 6/2016 | Jaszewski | |
| 9,403,588 | B1 | 8/2016 | George et al. | |
| 9,701,383 | B1 | 7/2017 | Stuber et al. | |
| 9,963,213 | B1 | 5/2018 | Jaszewski et al. | |
| 9,969,475 | B1 | 5/2018 | Waisanen | |

* cited by examiner

*Primary Examiner* — Lars A Olson
(74) *Attorney, Agent, or Firm* — Andrus Intellectual Property Law, LLP

(57) ABSTRACT

An outboard motor has a powerhead; a supporting cradle supporting the powerhead, the supporting cradle having port and starboard sides extending alongside opposite sides of the outboard motor; a resilient mount coupling the powerhead to the supporting cradle and being configured to absorb vibrations of the powerhead; and a tie bar mounting bracket having a head portion located aftwardly of the supporting cradle and further having port and starboard arms extending forwardly from the head portion alongside the opposite sides of the outboard motor and being coupled to the port and starboard sides of the supporting cradle, respectively. A cooling system conveys cooling water through the outboard motor and has a telltale outlet that discharges cooling water through the tie bar mounting apparatus.

19 Claims, 7 Drawing Sheets

OUTBOARD MOTORS AND TIE BAR APPARATUSES FOR COUPLING AN OUTBOARD MOTOR TO AN ADJACENT OUTBOARD MOTOR

FIELD

The present disclosure relates to outboard motors, and more particularly to outboard motors having tie bar mounting brackets for coupling the outboard motor to an adjacent outboard motor, and still further to cooling systems for outboard motors having a telltale outlet.

BACKGROUND

The present US patents are incorporated herein by reference in entirety:

U.S. Pat. No. 9,969,475 discloses a system for mounting an outboard motor propulsion unit to a marine vessel transom, including a support cradle having a head section coupled to a transom bracket and a pair of arms extending aftward from the head section and along opposite port and starboard sides of the propulsion unit. A pair of upper mounts is provided, each upper mount in the pair coupling a respective arm to the propulsion unit aft of a center of gravity of a powerhead system of the propulsion unit. A pair of lower mounts is also provided, each lower mount in the pair coupling the propulsion unit to the transom bracket. The pair of upper mounts is located aft of the pair of lower mounts when the propulsion unit is in a neutral position, in which the propulsion unit is generally vertically upright and not tilted or trimmed with respect to the transom.

U.S. Pat. No. 9,963,213 discloses a system for mounting an outboard motor propulsion unit to a marine vessel transom. The propulsion unit's midsection has an upper end supporting a powerhead system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. Pat. No. 9,701,383 discloses a marine propulsion support system including a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,403,588 discloses systems for cooling a marine engine that is operated in a body of water. The systems can include an open loop cooling circuit for cooling the marine engine, wherein the open loop cooling circuit is configured to convey cooling water from the body of water to the marine engine so that heat is exchanged between the cooling water and the marine engine, and a pump that is configured to pump the cooling water from upstream to downstream through the open loop cooling circuit. A heat exchanger is configured to cause an exchange of heat between the cooling water located upstream of the marine engine and the cooling water located downstream of the marine engine to thereby warm the cooling water located upstream of the marine engine, prior to cooling the marine engine.

U.S. Pat. No. 9,376,191 discloses an outboard motor to be coupled to a transom of a marine vessel, including a midsection housing having a front side configured to face the transom, a back side opposite the front side, a left side, and an opposite right side. A powerhead having a powerhead block is mounted directly to and supported by the midsection housing. A driveshaft is coupled in torque transmitting relation with a crankshaft of the engine, and a portion of the driveshaft is located exterior to the midsection housing. An exhaust pipe that conveys exhaust gas from an exhaust gas outlet of the engine downwardly away from the engine is also located exterior to the midsection housing. In one example, the midsection housing serves as a sump for engine oil.

U.S. Pat. No. 9,365,274 discloses an outboard marine propulsion device having an internal combustion engine with a cylinder head and a cylinder block and an exhaust manifold that discharges exhaust gases from the engine towards a vertically elongated exhaust tube. The exhaust manifold has a plurality of inlet runners that receive the exhaust gases from the engine, and a vertically extending collecting passage that conveys the exhaust gases from the plurality of inlet runners upwardly to a bend that redirects the exhaust gases downwardly towards the exhaust tube. A cooling water jacket is on the exhaust manifold and conveys cooling water alongside the exhaust manifold. A catalyst housing is coupled to the exhaust manifold and a cooling water jacket is on the catalyst housing and carries cooling water alongside the catalyst housing. A catalyst is disposed in the catalyst housing.

U.S. Pat. No. 8,512,085 discloses a tie bar apparatus for a marine vessel having at least first and second marine drives. The tie bar apparatus comprises a linkage that is geometrically configured to connect the first and second marine drives together so that during turning movements of the marine vessel, the first and second marine drives steer about respective first and second vertical steering axes at different angles, respectively.

U.S. Pat. No. 8,500,501 discloses an outboard marine drive having a cooling system drawing cooling water from a body of water in which the outboard marine drive is operating, and supplying the cooling water through cooling passages in an exhaust tube in the driveshaft housing, a catalyst housing, and an exhaust manifold, and thereafter through cooling passages in the cylinder head and the cylinder block of the engine. A 3-pass exhaust manifold is provided. A method is provided for preventing condensate formation in a cylinder head, catalyst housing, and exhaust manifold of an internal combustion engine of a powerhead in an outboard marine drive.

U.S. Pat. No. 7,207,854 discloses a tie bar arrangement that uses a rod end cartridge assembly that provides relative rotate-ability between an associated rod end and a coupler tube. The provision of a connecting link and steering arm adapter associated with the rod end cartridge assembly also provides relative rotation about first and second axes which allow sufficient flexibility to avoid placing the tie bar arrangement under excessive stress when one marine propulsion device is tilted relative to another marine propulsion device.

U.S. Pat. No. 6,913,497 discloses a connection system for connecting two or more marine propulsion devices, which together provides a coupler that can be rotated in place, without detachment from other components, to adjust the distances between the tie bar arms. In addition, the use of various clevis ends and pairs of attachment plates on the components significantly reduces the possibility of creating moments when forces and their reactions occur between the various components.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

An outboard motor has a powerhead; a supporting cradle supporting the powerhead, the supporting cradle having port and starboard sides extending alongside opposite sides of the outboard motor; a resilient mount coupling the powerhead to the supporting cradle and being configured to absorb vibrations of the powerhead; and a tie bar mounting bracket having a head portion located aftwardly of the supporting cradle and further having port and starboard arms extending forwardly from the head portion alongside the opposite sides of the outboard motor and being coupled to the port and starboard sides of the supporting cradle, respectively. A cooling system conveys cooling water through the outboard motor and has a telltale outlet that discharges cooling water through the tie bar mounting apparatus.

BRIEF DESCRIPTION OF THE DRAWINGS

Examples of outboard motors are herein disclosed with reference to the following drawing figures. The same numbers are used throughout to reference like features and components.

DETAILED DESCRIPTION OF THE DRAWINGS

Figure 1:
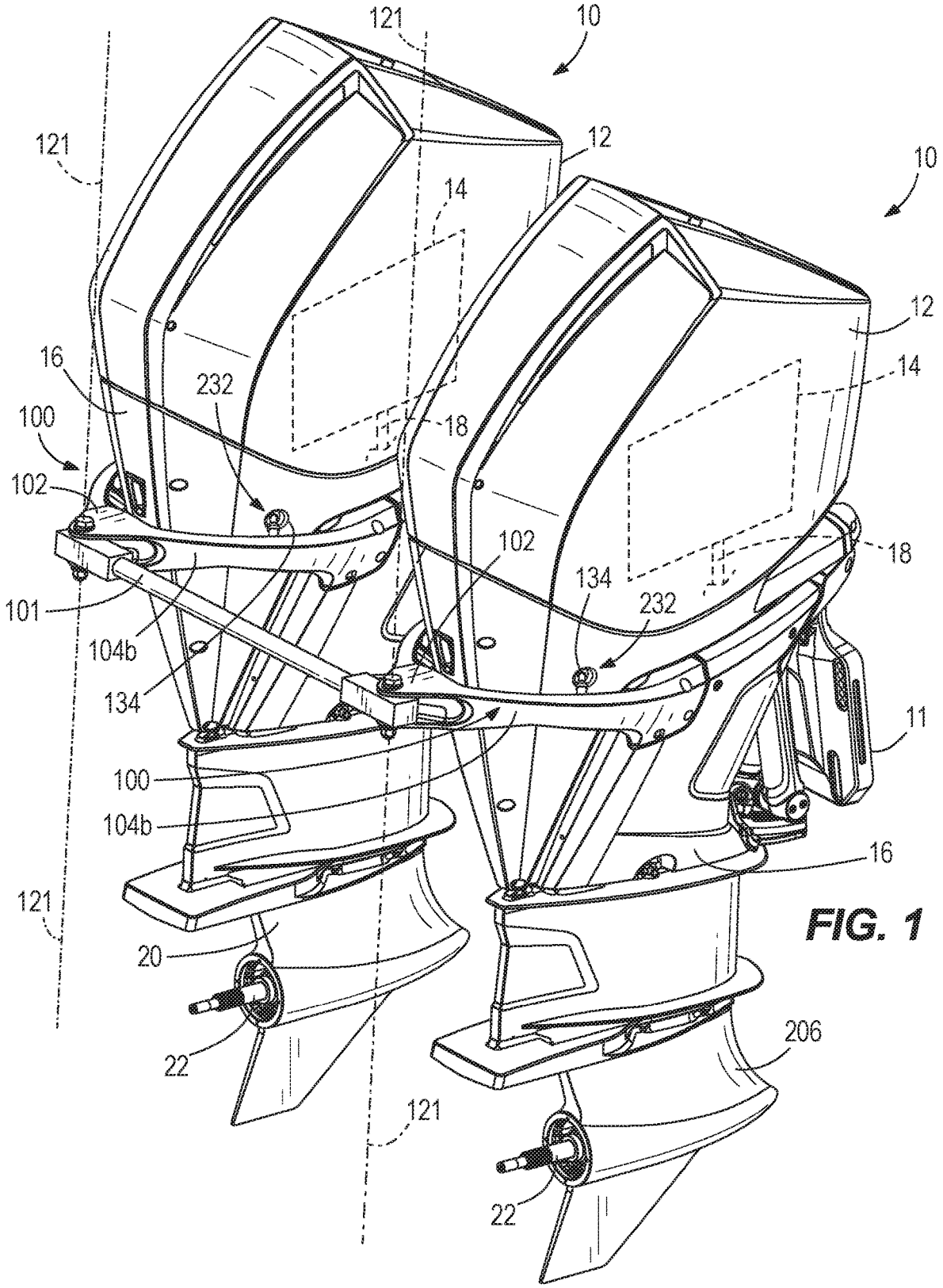
FIG. 1 is a perspective view of an outboard motor and a tie bar mounting bracket configured according to the present disclosure.

FIG. 1 depicts an outboard motor 10 according to the present disclosure. The outboard motor 10 has a conventional transom bracket 11, which is configured for attachment to a transom of a marine vessel. The outboard motor 10 further has a top cowl 12 which covers a powerhead, which for example can include an internal combustion engine, shown schematically at 14. The type and configuration of the internal combustion engine can vary and for example can include a conventional V-shaped engine or a conventional inline engine. The outboard motor 10 further has a midsection 16 through which a driveshaft 18 extends and a lower gearcase 206 containing a gearset connecting the driveshaft 18 to a propeller shaft 22. The midsection 16 can be referred to as a driveshaft housing. The midsection 16 extends below the powerhead and extends, for example, from an adapter plate or chap plates located below the powerhead 14, all as is conventional. Operation of the powerhead 14 causes rotation of the driveshaft 18, which in turn causes rotation of the propeller shaft 22 via the gearset. A propeller (not shown) attached to the propeller shaft 22 rotates with the propeller shaft 22, which propels the marine vessel in water.

Figure 3:
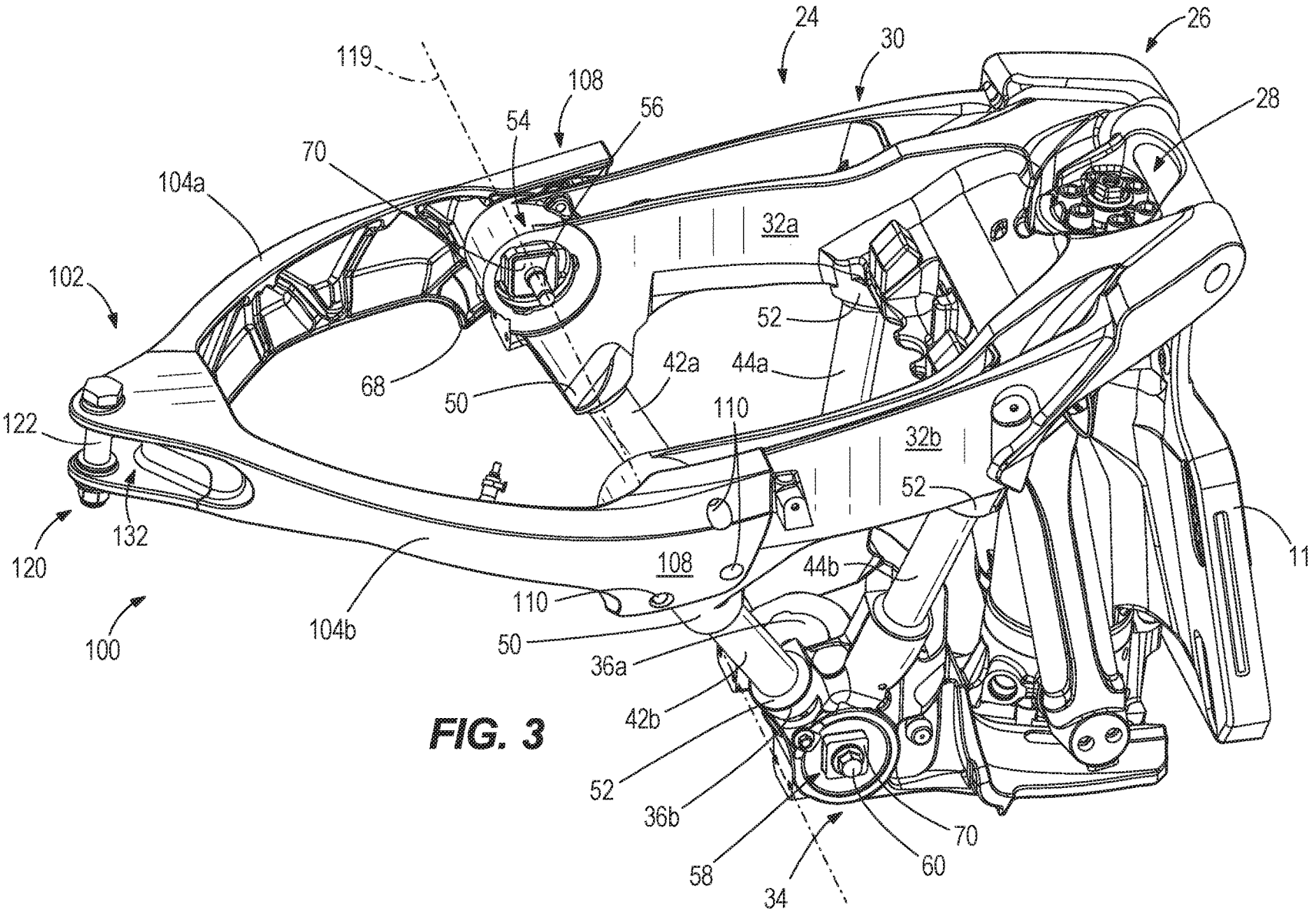
FIG. 3 is a perspective view of the tie bar mounting bracket connected to a supporting cradle for the outboard motor.
Figure 4:
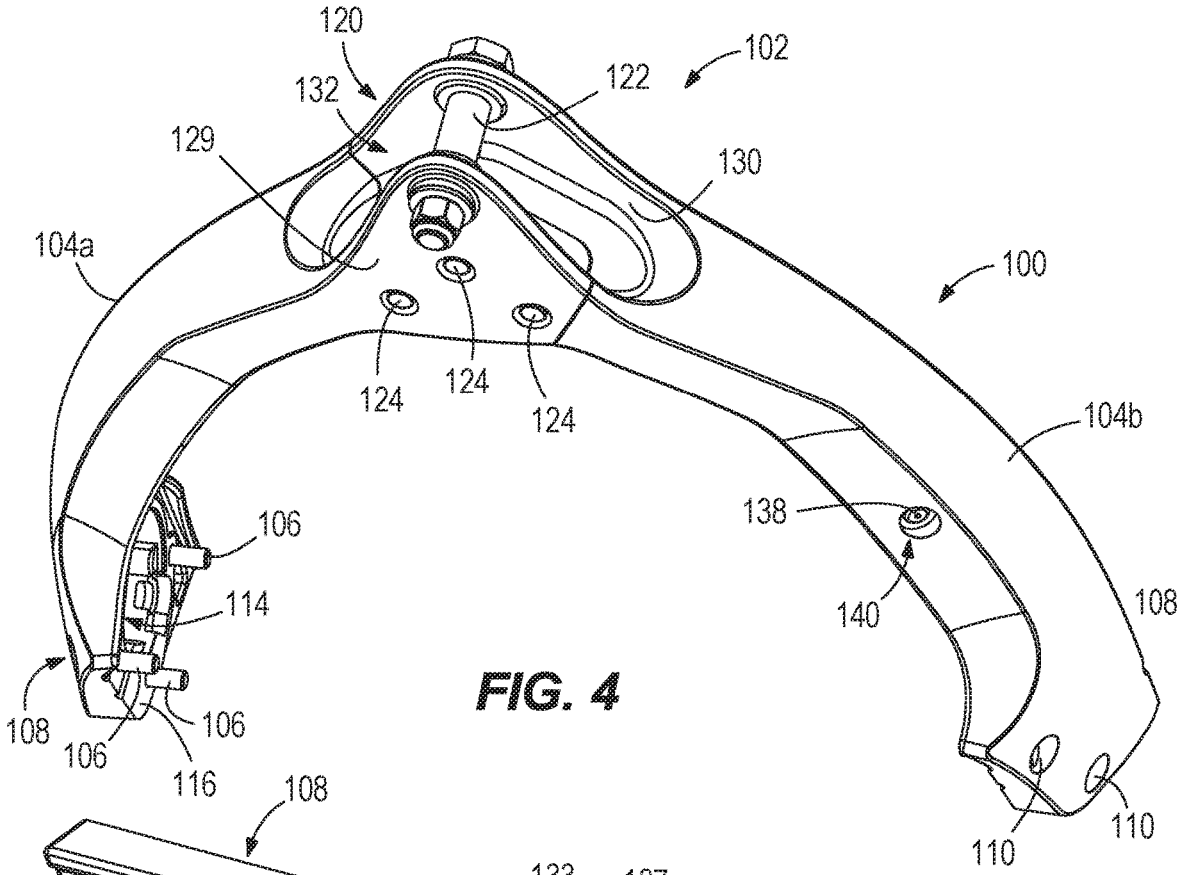
FIG. 4 is a perspective view looking up at the tie bar mounting bracket.

Referring to FIG. 3, a supporting cradle 24 supports the powerhead 14 with respect to the outboard motor 10 and the corresponding marine vessel. The supporting cradle 24 is configured like the supporting cradle disclosed in Brunswick U.S. Pat. No. 9,969,475, which is incorporated herein by reference. The supporting cradle 24 has a head section 26 coupled to the transom bracket 11 at the foremost end of the head section 26, proximate the location of a tilt tube 28. The supporting cradle 24 includes an upper structural support section 30 extending aftwardly from the head section 26, and particularly alongside opposite port and starboard sides of the midsection 16. The upper structural support section 30 includes a port and starboard arms 32*a*, 32*b* extending aftwardly from the head section 26 and alongside opposite port and starboard sides of the midsection 16. The supporting cradle 24 further includes a lower structural support section 34 suspended from the upper structural support section 30. The lower structural support section 34 includes port and starboard Y-shaped yokes 36*a*, 36*b* on the port and starboard sides of the midsection 16.

The supporting cradle 24 further includes port and starboard connector sections that respectively couple the upper structural support section 30 to the lower structural support section 34. The port and starboard connector sections have tubular extrusions 42*a*, 42*b* that couple port and starboard aft ends of the upper structural support section 30 to the port and starboard aft sides of the lower structural support section 34 and tubular extrusions 44*a*, 44*b* that couple the port and starboard fore sides of the upper structural support section 30 to the port and starboard fore sides of the lower structural support section 34.

To accommodate the tubular extrusions 42*a*, 42*b*, 44*a*, 44*b*, the upper structural support section 30 has an aft pair of tubular receiving portions 50 respectively depending from the port and starboard aft ends of the upper structural support section 30 and respectively attached to the tubular extrusions 42*a*, 42*b*. A fore pair of tubular receiving portions 52 depends from the port and starboard fore ends of the upper structural support section 30, respectively, and is attached to the pair of tubular extrusions 44*a*, 44*b*, respectively.

A pair of upper resilient mounts 54 couples the upper structural support section 30 to the midsection 16 proximate the powerhead 14 via fasteners 56 that extend in the port-starboard direction through a center aperture in each upper resilient mount 54. Each upper resilient mount 54 couples a respective arm 32*a*, 32*b* to the midsection 16. A pair of lower resilient mounts 58 (only one is shown in FIG. 3) couples the lower structural support section 34 to the midsection 16 proximate the lower gearcase 20 via lower fasteners 60 that extend in the port-starboard direction through a center aperture in each lower resilient mount 58.

As further described and depicted in Brunswick U.S. Pat. No. 9,969,475, which is incorporated herein by reference, each upper and lower resilient mount 54, 58 includes a central shaft with a cylindrical aperture that receives the fastener 56 & 60. The central shaft is made of a non-elastomeric material configured to rigidly and securely hold the fastener 56. An elastomeric material surrounds the central shaft. The elastomeric material can have a generally cross-shaped structure, with four arms that connect to an outer shell. The shape of the elastomeric material can vary and can be configured to provide varying spring constants to the upper and lower resilient mounts 54, 58 depending on the direction in which the forces from the outboard motor are transferred to the upper and lower resilient mounts 54, 58. The outer shell is made of a non-elastomeric material, and is fitted into an aperture 68 in the aft end of each arm 32*a*, 32*b* of the support cradle 24. As shown, the aperture 68 extends in the lateral, port-starboard direction, as do the mounts 54 and the fasteners 56. An inner end of the fastener 56 is configured to extend into the midsection 16 to support and secure the midsection 16 with respect to the supporting cradle 24. For example, the inner ends of the fasteners 56 can extend into a driveshaft housing or adapter plate associated with the midsection 16, all as described in U.S. Pat. No. 9,969,475, which is incorporated herein by reference. Each of the upper and lower resilient mounts 54 and 58 have the non-elastomeric outer shell.

Figure 8:
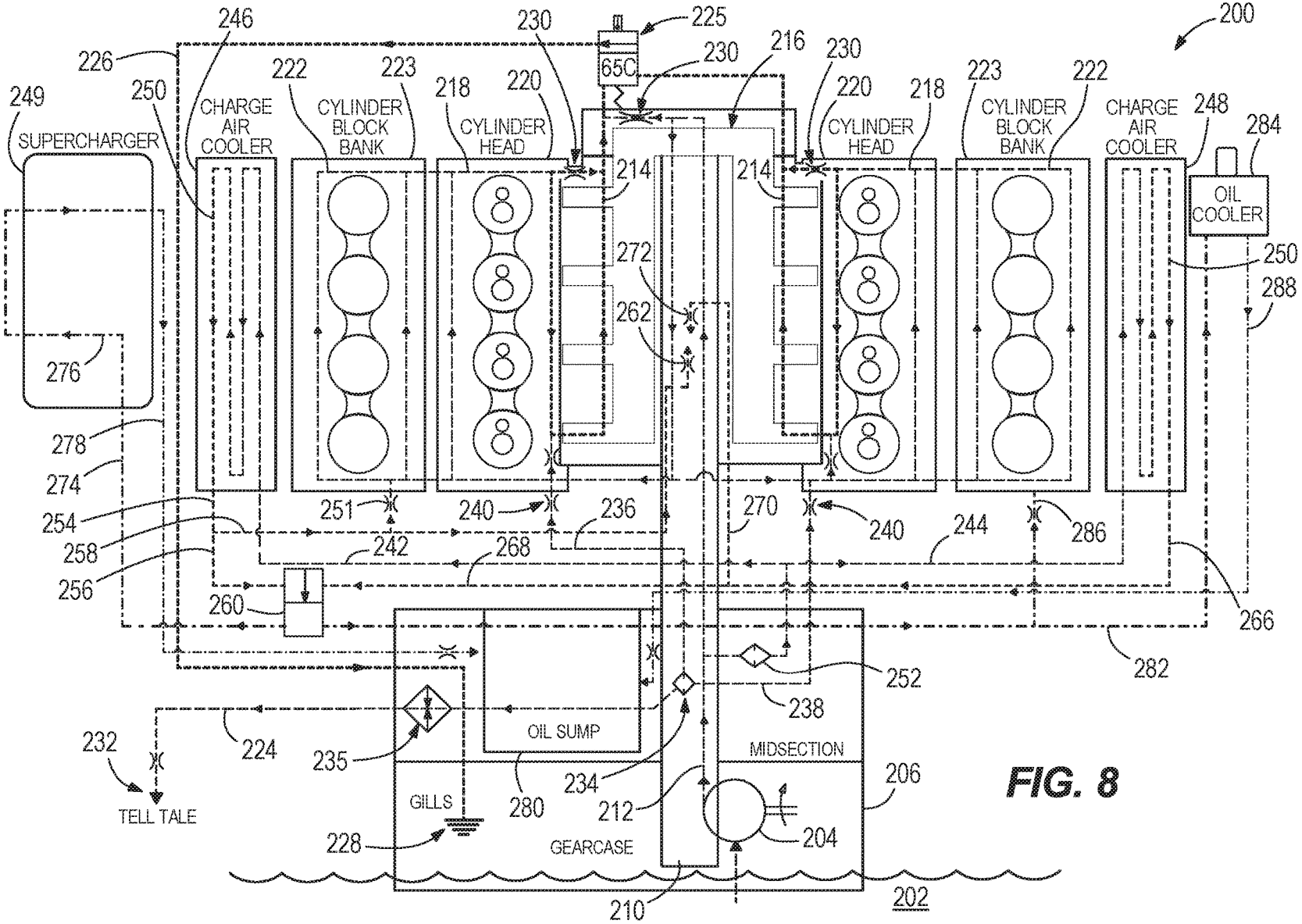
FIG. 8 schematically depicts a cooling system for the outboard motor.

FIG. 8 is a schematic depiction of an exemplary cooling system 200 for the engine 14 according to the examples provided herein above, which can be configured for use with the outboard motor 10. The cooling system 200 is particularly an "open loop" cooling system, which supplies relatively cold cooling water from the body of water 202 in which the outboard motor 10 is operating to the engine 14 and related components to thereby cool the engine 14 and related components, and then returns relatively warm (i.e., "spent") cooling water to the body of water 202. Open loop cooling systems are known in the art and examples are disclosed in U.S. Pat. No. 9,403,588, among others. The cooling system 200 of FIG. 14 has various cooling water passages, conduits, branch passages, inlets, outlets, ports, and the like, which are depicted via dashed lines and dash-and-dot lines. These items can constitute conventional tubes, fittings, cast passages, jackets, bored holes, and/or the like. The particular configuration of the respective cooling water passages, conduits, branch passages, inlets, outlets, ports, and the like can vary as long as the item is capable of conveying cooling water and preforming the functions described herein below, all as will be understood by one having ordinary skill in the art.

The cooling system 200 includes a conventional cooling water pump 204, which is located in the lower gearcase 206 of the outboard motor. The cooling water pump 204 is coupled to a portion of the driveshaft that extends into the lower gearcase 206, and/or any other similar output component of the marine engine, in particular so that operation of the marine engine powers the cooling water pump 204 and thereby causes the cooling water pump 204 to draw cooling water into the lower gearcase 206, via for example inlet openings on the lower gearcase 206. In alternate examples, the cooling water pump 204 is an electric pump that is electrically-powered, for example by a battery. In both examples, the cooling water pump 204 pumps the cooling water upwardly through a cooling water passage 212 alongside the exhaust conduit 210 of the engine 10. In some examples, at least a portion of the cooling water passage 212 is defined by a cooling water jacket that is cast onto the exterior of the exhaust conduit 210. This type of arrangement is taught in U.S. Pat. Nos. 9,365,274 and 10,336,428, which are incorporated herein by reference, among others, and thus is not further herein described. In the illustrated example, the cooling water passage 212 conveys the cooling water upwardly and then back downwardly alongside the exhaust conduit 210, and then to both port and starboard sides of the engine 10, particularly in series through cooling water passages 218 in the port and starboard cylinder heads 220, cooling water passages 222 in the port and starboard cylinder blocks 223, and then back through cooling water passages 214 alongside the port and starboard exhaust runners and/or exhaust log 216. Similar cooling water passage configurations are disclosed in the presently-incorporated U.S. Pat. Nos. 9,365,274 and 8,479,691. The cooling water passages 214 can be defined by for example cast cooling water passages on the exhaust runners and/or log 216. See for example the presently-incorporated U.S. Pat. No. 9,359,058. Cooling water flow directions are illustrated by arrowheads in FIG. 8.

A thermostat valve 225 is located on top of the exhaust conduit 210 and configured to automatically open and close based upon temperature so as to control discharge of the cooling water from the marine engine via an outlet passage 226, which leads to a discharge outlet 228 located on the lower gearcase 206 and discharging the cooling water back to the body of water 202. The thermostat valve 225 is thus configured to automatically control temperature of the engine 10. An example of such thermostatic control is provided in U.S. Pat. No. 9,365,274, which is imported herein by reference. In some examples, the thermostat valve 225 is a conventional item that can be purchased from Mercury Marine, part number 8M0109002, which is configured to automatically open when the cooling water reaches a 65 degree Celsius threshold. Several orifices 230 exist at the high points of the coolant passages that are configured to allow air to bleed from the cooling water passage 212 via the thermostat valve 225, as is conventional and disclosed in the above-incorporated patents, particularly with reference to U.S. Pat. No. 9,650,937, which is incorporated herein by reference.

The cooling system 200 has a branch passage 224, which conveys a portion of the cooling water from the cooling water passage 212 to a telltale outlet 232 on the outboard motor, which indicates to the operator whether cooling water is properly flowing through the cooling system 200 by continuously discharging a stream of cooling water back to the body of water 202 while the outboard motor is operating. The telltale outlet 232 is located on the outboard motor at a point that remains above the body of water 202 so that the stream of cooling water can be seen by the operator. The location and configuration of the telltale outlet 232 are further described herein below. A strainer 234 mounted on the exhaust conduit 210 strains the cooling water flow from the cooling water passage 212 to the branch passage 224. As shown in FIG. 8, the branch passage 224 conveys the cooling water through a cooler 235 for cooling a fuel pump and fuel that is supplied to the marine engine, for example as taught in U.S. Pat. No. 10,047,661, which is incorporated herein by reference.

Branch passages 236, 238 convey the cooling water from the strainer 234 to orifices 240 on the port and starboard cylinder heads 220, which supply cooling water to the cooling water passages 218 in the cylinder heads 220, i.e., so as to merge with the above-described cooling water flowing through the cylinder heads 220. When the cooling water pump 204 is active, cooling water is conveyed to the cooling water passages 218 in the cylinder heads 220 via the orifices 240. When the cooling water pump 204 is inactive, the cooling water is permitted to drain by gravity from the cooling water passages 218 via the orifices 240 to a leak hole in the cooling water pump 204 and then back to the body of water 202.

Branch passages 242, 244 convey the cooling water from the cooling water passage 212 to port and starboard charge air coolers 246, 248, which are configured to cool charge air from supercharger 249 prior to discharge to the marine engine. The port and starboard charge air coolers 246, 248 each have cooling water passages 250, which convey the cooling water from the branch passages 242, 244, respectively, in four passes through the respective charge air cooler 246, 248. During operation of the outboard motor, the charge air is distributed across the four passes of the cooling water passages 250 prior to combustion in the engine 10. A strainer 252 mounted on the exhaust conduit 210 strains the cooling water conveyed from the cooling water passage 212 to the branch passages 242, 244.

The cooling water from the port charge air cooler 246 is conveyed to a branch passage 254 and then to branch passages 256, 258, which convey cooling water respectively in parallel to a control valve 260 and to a sprayer 262 for spraying cooling water into the exhaust gas flowing through the exhaust conduit 210. The type and configuration of the control valve 260 can vary. In the presently illustrated embodiment, the control valve 260 is a poppet valve, one example being Mercury Marine part no. 8M0149190. The sprayer 262 is a known device, and is disclosed in U.S. Pat. Nos. 10,233,818 and 10,336,428, which are incorporated herein by reference, and thus is not further herein described. A portion of the cooling water flowing through the branch passage 258 is discharged to the port cylinder block 223 via a port 251 and mixes with the cooling water flowing through the cooling water passage 222 in the port cylinder block 223. When the cooling water pump 204 is inactive, the port 251 provides a drain for draining cooling water from the port cylinder block 223.

The cooling water from the starboard charge air cooler 248 is conveyed to a branch passage 266 and then to branch passages 268, 270, which convey cooling water respectively in parallel to the poppet valve 260 and to a sprayer 272 for spraying cooling water into the exhaust gas flowing through the exhaust conduit 210. Just like the sprayer 262, the sprayer 272 is a known configuration and is fully described in U.S. Pat. Nos. 10,233,818 and 10,336,428, which are incorporated herein by reference.

The poppet valve 260 is configured so as to actively control flow of cooling water from the branch passages 256, 268 to a branch passage 274, which feeds cooling water to a cooling water passage 276 for cooling the supercharger 249. In particular, the poppet valve 260 is configured to remain closed at relatively low operating pressures of the cooling system and to automatically open at relatively high pressures of the cooling system, for example at a preselected operating pressure that is chosen at setup of the marine engine so as to provide the necessary cooling water flow to components of the marine engine at higher operating pressures so as to prevent overheating thereof. Because of the parallel flow, regardless of whether the poppet valve 260 is open or closed, cooling water is continuously provided in parallel to the sprayers 262, 272. When the poppet valve 260 is closed, cooling water is not provided to the cooling water passage 276 for the supercharger 249. When the poppet valve 260 opens, cooling water is provided to the cooling water passage 276 for the supercharger 249. The cooling water passage 276 for the supercharger 249 can be configured in the manner described herein above with respect to embodiments of FIGS. 1-13. Further description of how the poppet valve 260 operates and the advantages thereof is provided herein below.

Cooling water from the cooling water passage 276 is conveyed by a branch passage 278 to the exterior surface of an oil sump 280 containing oil for lubricating the marine engine, for cooling the oil sump 280 and the oil contained therein. One example of an apparatus for cooling an oil sump is a series of orifices configured to spray cooling water onto the exterior of the oil sump 280. This type of configuration is known in the art. Reference is also made to U.S. Pat. No. 9,365,274.

The poppet valve 260 is further configured to actively control flow of cooling water from the branch passages 256, 268 to a branch passage 282, which conveys the cooling water to an oil cooler 284 for cooling oil for lubricating the marine engine. A portion of the cooling water in the branch passage 282 is supplied to the starboard cylinder block 223 via a port 286 for mixing with the cooling water flowing through the cooling water passage 222 in the starboard cylinder block 223. When the cooling water pump 204 is inactive, the port 286 provides a drain for draining cooling water from the starboard cylinder block 223. Cooling water from the oil cooler 284 is conveyed by a branch passage 288 to the oil sump 280, for cooling of the oil sump 280 along with the cooling water from the branch passage 278.

Referring now to FIG. 1, it is conventional to mount multiple outboard motors adjacent to each other on the transom of a marine vessel for enhanced propulsion and control of the marine vessel in water. The adjacent outboard motors are often rigidly connected or "tied' together by a "tie bar" extending between the aftward sides of the outboard motors, and being particularly configured so that steering movement of one of the outboard motors is mimicked by the adjacent outboard motor. During research and development of this type of arrangement, the present inventors endeavored to provide a novel tie bar apparatus having a robust and functionally efficient design. The present inventors determined it would be desirable to rigidly couple the tie bar apparatus to the "un-sprung" side of the outboard motor 10, i.e., the portion of the outboard motor that is rigidly connected to the transom bracket 11 and thus rigidly connected to the transom of the marine vessel. Conversely, the "sprung" side of the outboard motor 10 was found by the inventors to be a less desirable mounting location for the tie bar apparatus. The sprung side of the outboard motor 10 includes for example the powerhead 14 which is resiliently mounted and thus movable with respect to the rigid supporting cradle 24 and transom bracket 11 via the upper and lower resilient mounts 54, 58. The sprung side can also include the midsection 16, the lower gearcase 20 and associated propeller shaft 22. Also, through continued research and development, the present inventors determined it would be possible, and in fact desirable, to connect the telltale outlet 232 for the outboard motor's cooling system 200 to the tie bar apparatus, and even more particularly through the tie bar apparatus at a location that is easily seen by the operator standing in front of or behind outboard motor 10, and so that the tie bar apparatus and the cowling of the outboard motor 10 do not obstruct or otherwise impede the notice function of the telltale outlet 232. The present disclosure provides results of the above conceptions made by the present inventors.

Referring to FIGS. 1-6, a tie bar apparatus includes a tie bar mounting bracket 100 and a tie bar 101, which together connect the outboard motor 10 to an adjacent identical outboard motor 10 on the transom of the marine vessel. The tie bar mounting bracket 100 has a head portion 102 located aftwardly of the supporting cradle 24 (see FIG. 2). The tie bar mounting bracket 100 further has port and starboard arms 104*a*, 104*b* that extend forwardly from the head portion 102 alongside opposite port and starboard sides of the outboard motor 10, and particularly on opposite port and starboard sides of the midsection 16 of the outboard motor 10. The end portions of the port and starboard arms 104*a*, 104*b* are rigidly attached to the opposite sides of the supporting cradle 24 by removable fasteners 106, which are screws in the illustrated example. The outer end portions of the port and starboard arms 104*a*, 104*b* have an enlarged end flange 108 containing holes 110. Corresponding holes 112 are formed in the supporting cradle 24, and particularly at or adjacent to the aperture 68 for the upper resilient mount 54 in the aft end of the arm 32*a*, 32*b* of the support cradle 24 (see also FIG. 3). The enlarged end flanges 108 each have a recess 114 that corresponds to and faces the aperture 68 such that together the aperture 68 and recess 114 enclose the upper resilient mount 54. The inner surface 116 of the enlarged end flange 108 faces an outer mounting surface 118 on the supporting cradle 24 alongside of the aperture 68, and into which the fasteners 106 extending through the holes 110 are secured in the corresponding holes 112, thus rigidly connecting the port and starboard arms 104*a*, 104*b* to the opposite sides of the supporting cradle 24. As shown in FIG. 3, the supporting cradle 24 and tie bar mounting bracket 100 are configured such that the end flanges 108 of the port and starboard arms 104*a*, 104*b* are coupled to the opposite sides of the supporting cradle 24 along a common port-starboard axis 119 extending through the end flanges 108 and also extending through the fasteners 56.

Referring to FIG. 1, the tie bar 101 has opposing ends pivotally connected to each head portion 102 on the adjacent tie bar mounting brackets 100, such that the tie bar 101 is pivotable about vertical pivot axes 121. The tie bar 101 is pivotable with respect to the head portion 102 such that steering movements of the outboard motor 10 cause commensurate steering movements of the adjacent outboard motor, as is conventional. The type of pivotable connection between the tie bar 101 and head portion 102 can vary from what is shown. In the illustrated example, referring to FIGS. 3-5, the head portion has a clevis connector 120 with a fastener 122 forming a pivot pin. The end of the tie bar 101 is pivotable about the fastener 122.

Figure 6:
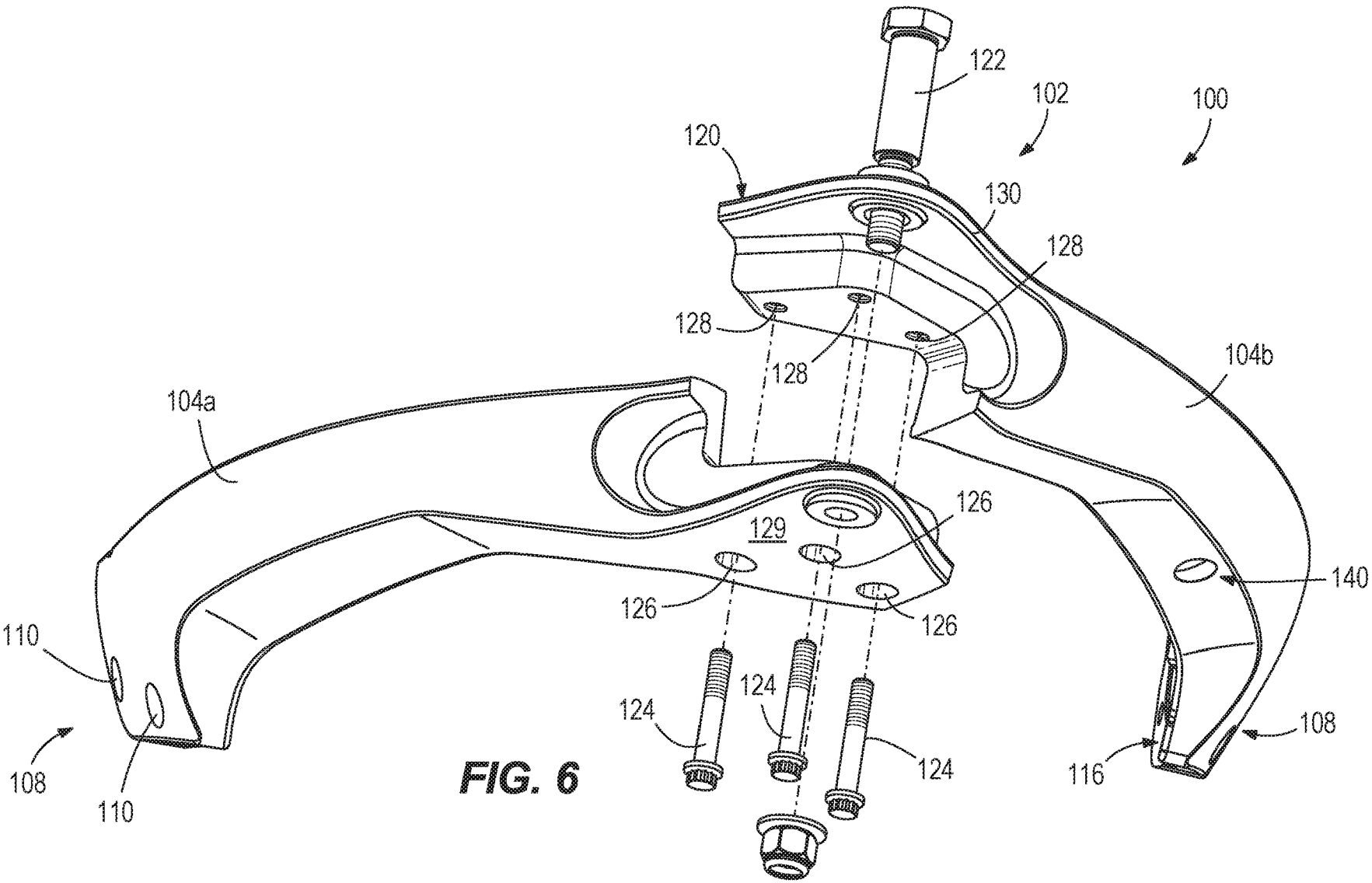
FIG. 6 is an exploded view of the tie bar mounting bracket.

Referring to FIG. 6, the port and starboard arms 104*a*, 104*b* of the tie bar mounting bracket 100 can be formed as separate components that are assembled together by three fasteners 124 extending through holes 126 and 128 in the head portion 102, particularly alongside each of the port and starboard arms 104*a*, 104*b*. In the illustrated example, the port arm 104*a* defines a lower portion 129 of the head portion 102 and the starboard arm 104*a*, 104*b* defines an upper portion 130 of the head portion 102, which mates with the lower portion 129 so as to define the clevis connector 120, including a gap 132 (see FIG. 3) between the lower and upper portions 129, 130 through which the pivot pin 122 extends and in which the end of the tie bar 101 is disposed (see FIG. 1). In other examples, the tie bar mounting bracket 100 is a one-piece (i.e., monolithic) component (e.g., casting).

Figure 2:
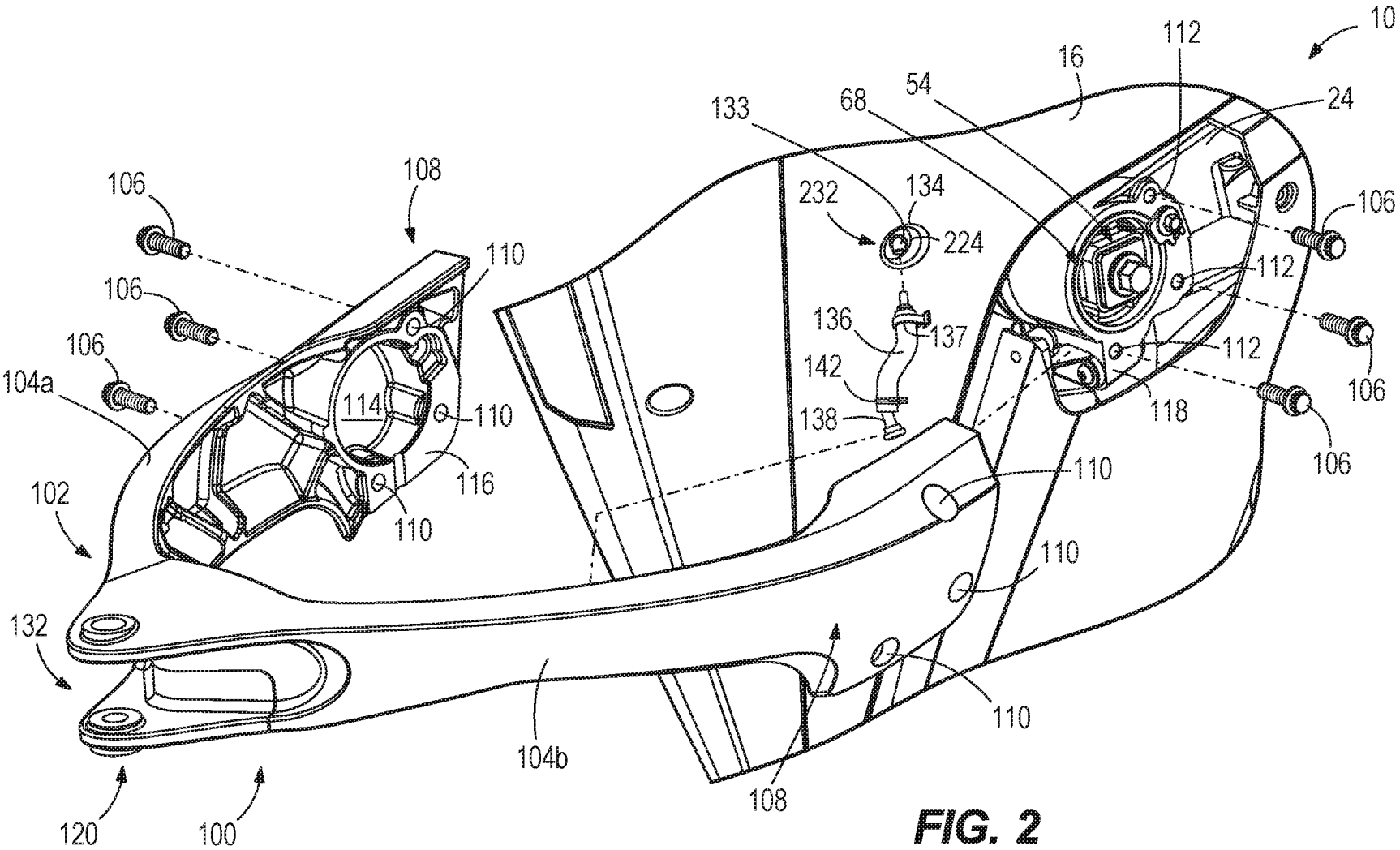
FIG. 2 is an exploded view of the tie bar mounting bracket and a portion of the outboard motor.
Figure 5:
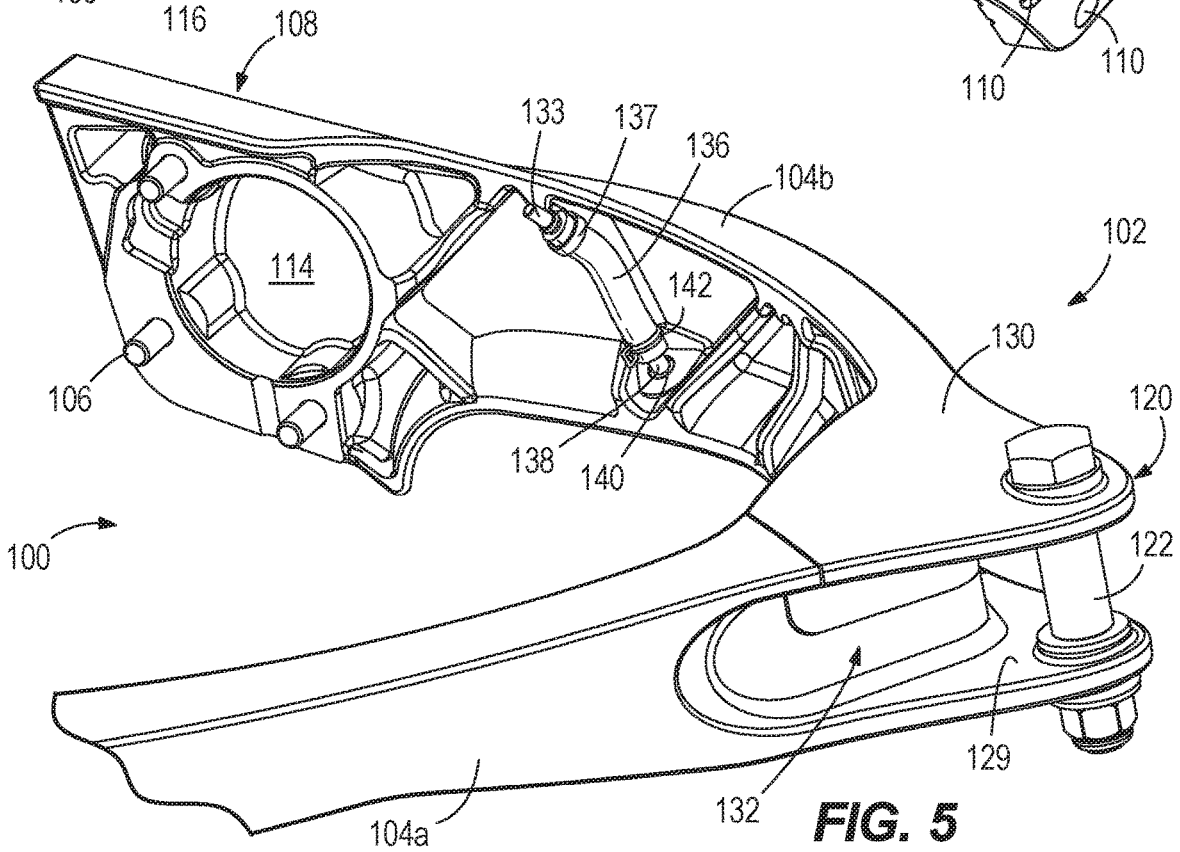
FIG. 5 is a perspective view looking down at the tie bar mounting bracket.
Figure 7:
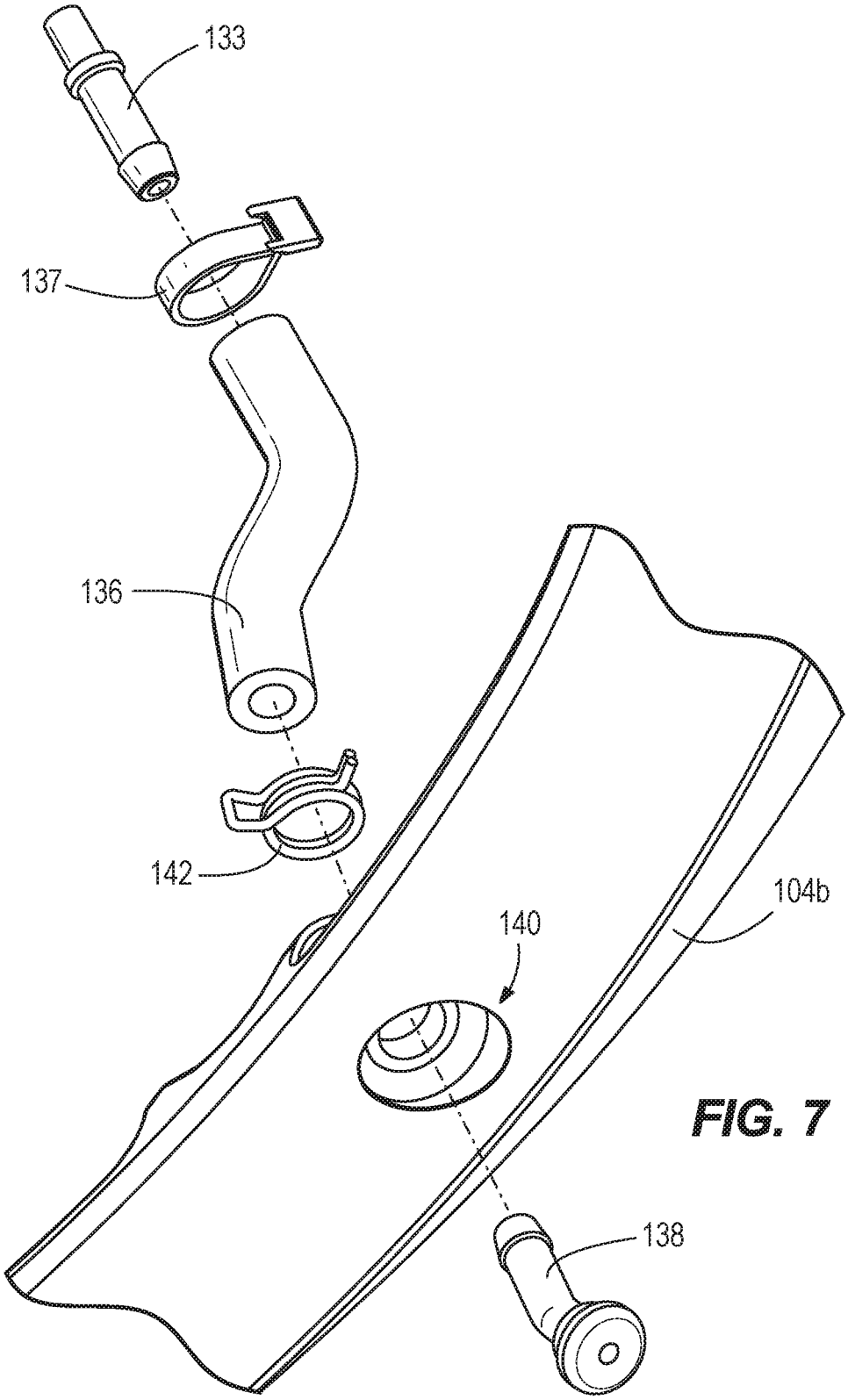
FIG. 7 is an exploded view of a telltale outlet for conveying a stream of cooling water through the tie bar mounting bracket.

Referring to FIG. 2, the telltale outlet 232 for discharging cooling water from the cooling system 200 includes a hole 134 formed through the cowling on the midsection 16 of the outboard motor 10, just above the starboard arm 104*b* of the tie bar mounting bracket 100. Referring to FIGS. 2, 5 and 7, a cooling water conduit 136, which in the illustrated example is a flexible hose, has a first end attached to an outlet nozzle 133 on the discharge line 224 in a water-tight connection via a clamp 137 and an opposite, second end attached to a discharge nozzle 138 extending through a hole 140 formed through the starboard arm 104*b*. The second end of the cooling water conduit 136 is attached to the discharge nozzle 138 in a water-tight fitting by a clamp 142. Advantageously the flexible hose of the cooling water conduit 136 permits the sprung side of the outboard motor 10, including the midsection 16 through which the hole 134 extend, to vibrate and otherwise move with respect to the un-sprung side of the outboard motor 10, including the supporting cradle 24 and tie bar mounting bracket 100. The hole 140 and discharge nozzle 138 are advantageously located on the widest portion of the port arm 104*b* of the tie bar mounting bracket 100 so that advantageously the stream of cooling water discharged from the telltale outlet 232 is visible by an operator standing in front of or behind the outboard motor 10.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An outboard motor comprising:

a powerhead;

a supporting cradle supporting the powerhead, the supporting cradle having port and starboard sides extending alongside opposite sides of the outboard motor;

a resilient mount coupling the powerhead to the supporting cradle and being configured to absorb vibrations of the powerhead; and a tie bar mounting bracket having a head portion located aftwardly of the supporting cradle and further having port and starboard arms extending forwardly from the head portion alongside the opposite sides of the outboard motor and being coupled to the port and starboard sides of the supporting cradle, respectively, wherein the resilient mount is one of port and starboard resilient mounts that couple the powerhead to the supporting cradle and are configured to absorb vibrations of the powerhead, and wherein the port and starboard arms of the tie bar mounting bracket are coupled to the port and starboard sides of the supporting cradle at a port-starboard axis along which the port and starboard mounts extend.

2. The outboard motor according to claim 1, wherein the port and starboard arms of the tie bar mounting bracket are rigidly coupled to the supporting cradle.

3. The outboard motor according to claim 1, further comprising a tie bar coupled to the head portion, the tie bar being configured to couple the outboard motor to an adjacent outboard motor such that steering movements of the outboard motor cause steering movements of the adjacent outboard motor.

4. The outboard motor according to claim 3, wherein the tie bar is pivotable with respect to the head portion.

5. The outboard motor according to claim 4, wherein the head portion comprises a clevis connector and wherein the tie bar is coupled to the tie bar mounting bracket via the clevis connector.

6. The outboard motor according to claim 1, wherein the port and starboard resilient mounts each have a fastener that extends through the respective port and starboard resilient mount and along the port-starboard axis, and an elastomeric material surrounding the fastener.

7. The outboard motor according to claim 6, wherein the port and starboard arms of the tie bar mounting bracket each have an end flanges coupled to the supporting cradle along the axis.

8. The outboard motor according to claim 7, wherein the port and starboard sides of the supporting cradle each have aperture that encloses a respective one of the port and starboard resilient mounts with respect to the supporting cradle.

9. An outboard motor comprising:

a powerhead;

a supporting cradle supporting the powerhead, the supporting cradle having port and starboard sides extending alongside opposite sides of the outboard motor;

a resilient mount coupling the powerhead to the supporting cradle and being configured to absorb vibrations of the powerhead; and a tie bar mounting bracket having a head portion located aftwardly of the supporting cradle and further having port and starboard arms extending forwardly from the head portion alongside the opposite sides of the outboard motor and being coupled to the port and starboard sides of the supporting cradle, respectively, wherein the port and starboard arms are connected together at the head portion by at least one fastener.

10. An outboard motor comprising:

a powerhead;

a supporting cradle supporting the powerhead, the supporting cradle having port and starboard sides extending alongside opposite sides of the outboard motor;

a resilient mount coupling the powerhead to the supporting cradle and being configured to absorb vibrations of the powerhead; and a tie bar mounting bracket having a head portion located aftwardly of the supporting cradle and further having port and starboard arms extending forwardly from the head portion alongside the opposite sides of the outboard motor and being coupled to the port and starboard sides of the supporting cradle, respectively, and further comprising a cooling system that conveys cooling water through the outboard motor, the cooling system comprising a telltale outlet that discharges cooling water through the tie bar mounting apparatus.

11. The outboard motor according to claim 10, wherein the telltale outlet discharges cooling water through a cowling on the outboard motor and then through the tie bar mounting apparatus.

12. The outboard motor according to claim 10, wherein the telltale comprises a hole formed through a widest portion of the tie bar mounting bracket relative to the port and starboard sides of the supporting cradle, so that a stream of water discharged from the telltale outlet is visible from in front of and behind the outboard motor.

13. The outboard motor according to claim 10, further comprising a flexible cooling water conduit that conveys the cooling water from an aperture through the cowling to a hole extending through the tie bar mounting apparatus, wherein the flexible cooling water conduit accommodates movement of the powerhead relative to the supporting cradle and tie bar mounting apparatus.

14. An outboard motor comprising:

a powerhead;

a cooling system that conveys cooling water from a body of water in which the outboard motor is operating to the powerhead and then back to the body of water, wherein the cooling system comprises a telltale outlet that discharges a stream of cooling water to the body of water during operation of the cooling system, thereby providing a visual indicator of the operational status of the cooling system; and a tie bar mounting bracket on the outboard motor, wherein the telltale outlet extends through the tie bar mounting bracket.

15. The outboard motor according to claim 14, wherein the telltale outlet discharges cooling water through a cowling on the outboard motor and then through the tie bar mounting apparatus.

16. The outboard motor according to claim 14, further comprising a supporting cradle supporting the powerhead, the supporting cradle having port and starboard sides extending alongside opposite sides of the outboard motor, wherein the tie bar mounting bracket comprises a head section and port and starboard arms extending forwardly from the head portion alongside the opposite sides of the outboard motor and being coupled to the port and starboard sides of the supporting cradle, respectively.

17. The outboard motor according to claim 16, wherein the telltale outlet extends through one of the port and starboard arms of the tie bar mounting bracket.

18. The outboard motor according to claim 16, wherein the telltale comprises a hole formed through a widest portion of the tie bar mounting bracket relative to the port and starboard sides of the supporting cradle, so that a stream of water discharged from the telltale outlet is visible from in front of and behind the outboard motor.

19. The outboard motor according to claim 16, further comprising a flexible cooling water conduit that conveys the cooling water from an aperture through the cowling to a hole extending through the tie bar mounting apparatus, wherein the flexible cooling water conduit accommodates movement of the powerhead relative to the supporting cradle and tie bar mounting apparatus.

* * * * *